US006117439A

United States Patent [19]

Kake

[11] Patent Number: 6,117,439

[45] Date of Patent: Sep. 12, 2000

[54] WET TISSUE

[75] Inventor: Masutaka Kake, Onomichi, Japan

[73] Assignee: Yugenkaisha Uenoyabikohen, Onomichi, Japan

[21] Appl. No.: 09/021,949

[22] Filed: Feb. 11, 1998

[30] Foreign Application Priority Data

Feb. 13, 1997 [JP] Japan ..... 9-001224

[51] Int. Cl.[7] ..... A01N 25/34; A61L 9/01

[52] U.S. Cl. ..... 424/404; 424/402; 424/76.9

[58] Field of Search ..... 424/402, 404

[56] References Cited

U.S. PATENT DOCUMENTS 4,906,656 3/1990 Laks ..... 514/456

FOREIGN PATENT DOCUMENTS 06321722 11/1994 Japan .

*Primary Examiner*—Thurman K. Page

*Assistant Examiner*—Todd D Ware

*Attorney, Agent, or Firm*—Armstrong, Westerman, Hattori, McLeland and Naughton

[57] ABSTRACT

A wet tissue prepared by impregnating a main body of paper-made tissue with a dilute aqueous solution of epigallocatechin gallate and introducing the impregnated main body into a waterproof container provided with a takeout hole. The tissue is withdrawn and cut through the hole and put to use.

4 Claims, 2 Drawing Sheets

WET TISSUE

BACKGROUND OF THE INVENTION

1. Field of the Invention

The present invention relates to a paper-made wet tissue having a deodorant effect.

2. Description of the Prior Art

Although the prior wet tissues impregnated with water and alcohol have an effect of wiping off dirt and a disinfective effect, they are insufficient from the viewpoint of deodorant effect. When such prior tissues are used for wiping off excrement or the like emitting an intense unpleasant odor, the used tissues emit an intense unpleasant odor in themselves and the residual excrement, even though it may be small in quantity, also retains an unpleasant odor.

SUMMARY OF THE INVENTION

With the aim of solving the problem mentioned above, the present inventors took notice of epigallocatechin gallate (tea-leaf tannin) constituting one component of tea and having an especially high deodorant effect. When a wet tissue is impregnated with epigallocatechin gallate, a deodorant effect is exhibited, the multiplication of bacteria is inhibited, and the wet tissue has a guaranteed safety for human body.

DETAILED DESCRIPTION OF THE INVENTION

The wet tissue of the present invention is characterized in that the main body of a continuous paper-made tissue previously provided with perforated lines extending in the longitudinal direction is impregnated with a dilute aqueous solution of epigallocatechin gallate, the impregnated main body of tissue is folded and packed into a box-form waterproof container provided with a takeout hole, and the tissue is withdrawn and cut into an arbitrary length through the takeout hole, and the cut tissue is put to use.

Alternatively, the wet tissue of the present invention can be so constructed that the main body of a continuous paper-made tissue previously provided with perforated lines extending in the longitudinal direction is impregnated with a dilute aqueous solution of epigallocatechin gallate and rolled up to form a roll-like material, the roll is introduced into a waterproof cylindrical container provided with a takeout hole in the upper portion thereof, the tissue is withdrawn and cut into an arbitrary length through the takeout hole, and the cut tissue is put to use.

The epigallocatechin gallate with which the wet tissue of the present invention is to be impregnated is a kind of catechins constituting the major component of tea-leaf tannin. It is called green tea flavonoid, too. It has an especially high deodorant effect and so high a safety for human body as conventionally used in chewing gum, and exercises an inhibitory effect on the multiplication of bacteria. Accordingly, it is effectively usable for wiping off the excrement emitting an intense unpleasant odor and retains cleanness and a high safety. Thus, it can give a wet tissue desirable from the viewpoint of environmental protection.

According to yet another embodiment of the present invention, the wet tissue of the present invention can be obtained, as well, by impregnating prior wet tissues enclosed in a box-form or roll-form container afterwards with a dilute aqueous solution of epigallocatechin gallate.

Figure 1:
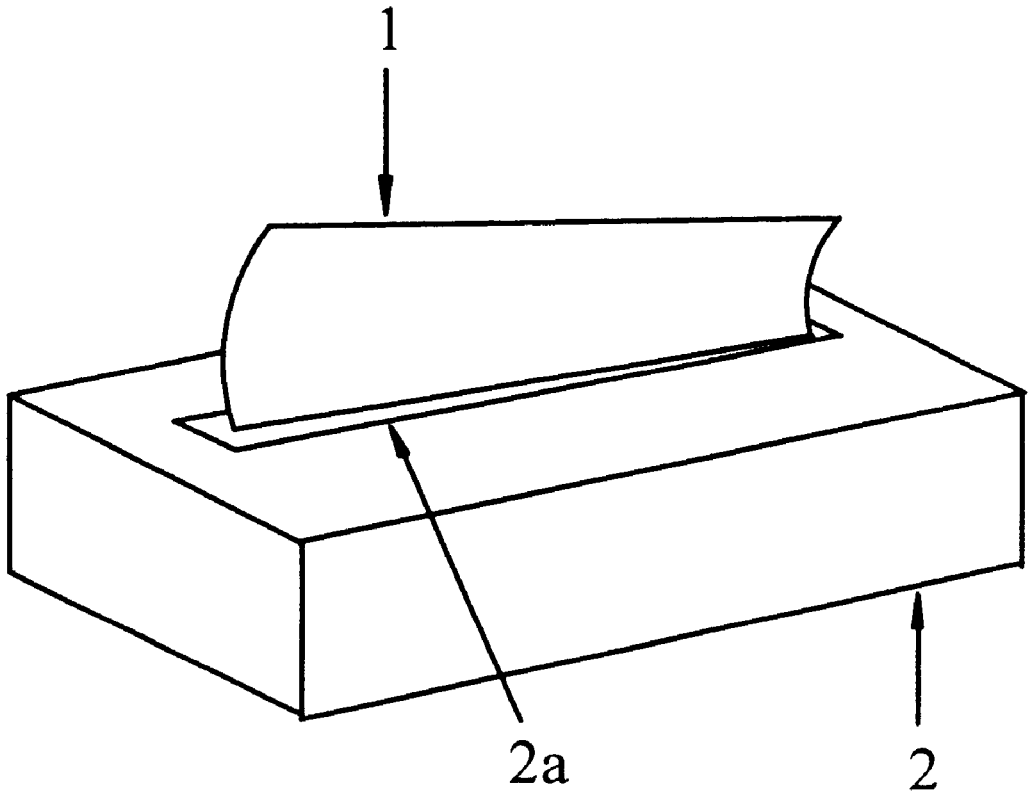
FIG. 1 is a perspective illustration of a wet tissue according to Example 1 of the present invention.

Next, embodiments of the present invention will be explained by referring to the accompanying drawings. FIG. 1 is a perspective illustration of a wet tissue according to Example 1 of the present invention. Example 1 is characterized by dissolving 3 grams of epigallocatechin gallate (tea-leaf tannin) in one liter of water with thorough stirring to prepare a dilute aqueous solution, impregnating a continuous main body (1) of tissue previously provided with perforated lines extending in the longitudinal direction with the dilute aqueous solution obtained above, folding the impregnated main body of tissue, introducing the folded matter into a waterproof box-form resin-made container (2) provided with a takeout hole (2*a*) in the upper portion thereof, and withdrawing and cutting the main body of tissue into an arbitrary length through the takeout hole, and putting the cut tissue to use.

Figure 2:
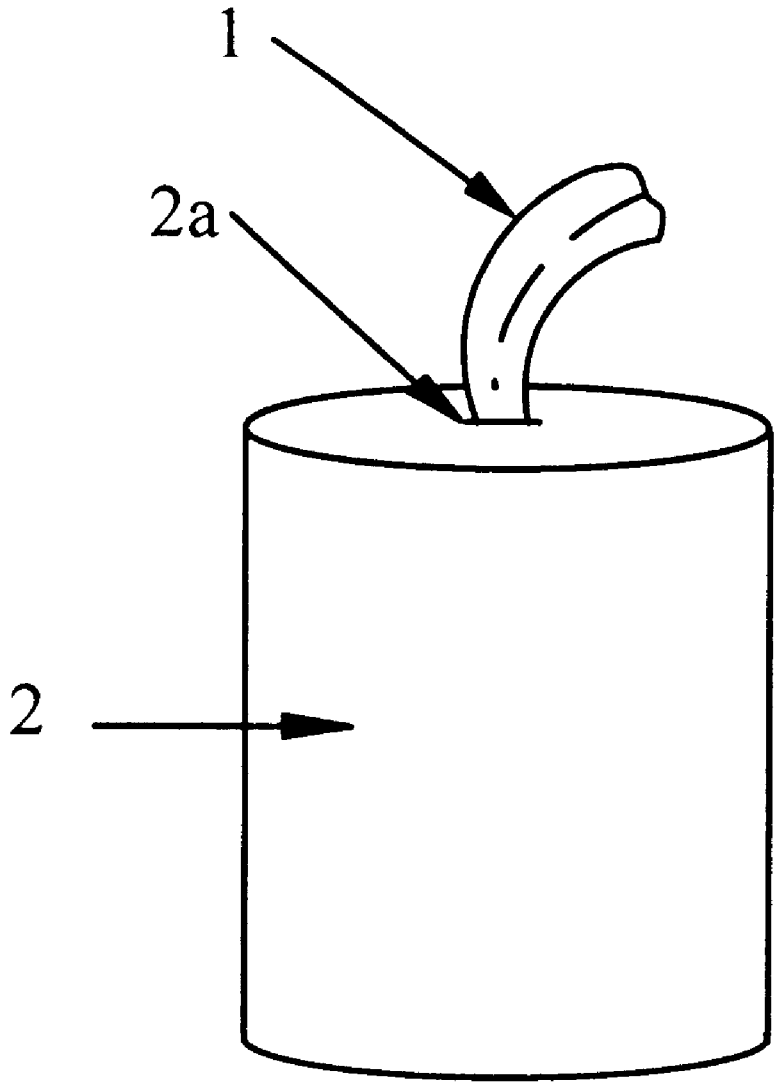
FIG. 2 is a perspective illustration of a wet tissue according to Example 2 of the present invention; wherein 1 is main body of tissue, and 2 is container.

FIG. 2 is a perspective illustration of a wet tissue according to Example 2 of the present invention. Example 2 is characterized by impregnating a continuous main body (1) of tissue previously provided with perforated lines extending in the longitudinal direction with the same dilute aqueous solution as above, rolling up the main body of tissue to prepare a roll-like material, introducing the roll-like material into a waterproof cylindrical container (2) equipped with a takeout hole (2*a*) in the upper portion thereof, withdrawing and cutting the main body of tissue through the takeout hole, and putting the cut tissue to use.

Effect of the Invention

The present invention is put into practice in the forms mentioned above to exhibit an effect mentioned below.

Thus, since the wet tissue of the present invention contains epigallocatechin gallate, it has an especially high deodorant effect and effectively inhibits the multiplication of bacteria with safety for human body. Accordingly, the wet tissue of the present invention is effectively usable for wiping off the excrement emitting an intense unpleasant odor or the like while retaining cleanness and a high safety. Thus, according to the present invention, a wet tissue desirable from the viewpoint of environmental protection can be obtained.

Further, if desired, a prior wet tissue can be converted to a wet tissue of the present invention by impregnating the prior wet tissue with the dilute aqueous solution of the present invention containing epigallocatechin gallate. Thus, according to the present invention, a wet tissue easy to handle and low in price can be obtained.

What is claimed is:

1. A wet tissue comprising a main body (1) of a paper-made tissue impregnated with a dilute aqueous solution containing epigallocatechin gallate.

2. A wet tissue dispenser comprising a main body of a paper-made tissue impregnated with a dilute aqueous solution containing epigallocatechin gallate and placed in a waterproof container provided with a takeout hole.

3. A wet tissue according to claim 1, wherein the proportion of epigallocatechin gallate in the aqueous solution is about 3 g/l.

4. A wet tissue dispenser according to claim 2, wherein the proportion of epigallocatechin gallate in the aqueous solution is about 3 g/l.

* * * * *